US011530661B2

(12) United States Patent
Ikeda et al.

(10) Patent No.: US 11,530,661 B2
(45) Date of Patent: Dec. 20, 2022

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventors: Yuto Ikeda, Kazaki (JP); Yuki Nose, Nagoya (JP); Takanobu Gotoh, Obu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/521,166

(22) Filed: Nov. 8, 2021

(65) Prior Publication Data

US 2022/0145818 A1 May 12, 2022

(30) Foreign Application Priority Data

Nov. 11, 2020 (JP) ..... JP2020-188006

(51) Int. Cl.
*F02D 41/02* (2006.01)
*F02D 41/00* (2006.01)
*F02D 41/14* (2006.01)

(52) U.S. Cl.
CPC ..... *F02D 41/025* (2013.01); *F02D 41/0087* (2013.01); *F02D 41/1408* (2013.01); *F02D 41/1454* (2013.01); *F02D 41/0055* (2013.01); *F02D 2200/0802* (2013.01); *F02D 2200/0812* (2013.01); *F02D 2200/0816* (2013.01)

(58) Field of Classification Search
CPC ..... F02D 41/025; F02D 41/0087; F02D 41/1454; F02D 41/0055; F02D 2200/0802; F02D 2200/0812; F02D 2200/0816; F02D 17/02; F02D 41/029; F02D 41/008;
(Continued)

(56) References Cited

U.S. PATENT DOCUMENTS 5,845,492 A * 12/1998 Isobe ..... F01N 3/32 60/284
6,560,960 B2 * 5/2003 Nishimura ..... F02D 41/126 60/284
(Continued)

FOREIGN PATENT DOCUMENTS

EP 1028243 A2 * 8/2000 ..... F02D 21/08
EP 1182340 A2 * 2/2002 ..... F02D 41/005
(Continued)

*Primary Examiner* — Hung Q Nguyen
(74) *Attorney, Agent, or Firm* — Oblon, McClelland, Maier & Neustadt, L.L.P.

(57) ABSTRACT

When an amount of PM trapped by a GPF is large and a request for regeneration is made, a CPU determines whether an execution condition for executing a temperature increasing process is satisfied. At a point in time t1, at which the execution condition is satisfied, the CPU executes a scavenging process to assign 1 to a condition satisfaction flag Ftr, cause the air-fuel ratio of air-fuel mixture in cylinders #1, #3, and #4 to be the stoichiometric air-fuel ratio, and stop a combustion operation in a cylinder #2. After a point in time t2, which is after a combustion cycle, the CPU executes a temperature increasing process. The temperature increasing process causes the air-fuel ratio of the air-fuel mixture in the cylinders #1, #3, and #4 to be richer than the stoichiometric air-fuel ratio, and stops the combustion operation in the cylinder #2.

7 Claims, 6 Drawing Sheets

(58) Field of Classification Search
CPC ... Y02T 10/12; F01N 3/20; F01N 9/00; F01N 2260/04
See application file for complete search history.

(56) References Cited

U.S. PATENT DOCUMENTS

| | | | | |
|---|---|---|---|---|
| 6,568,177 | B1 * | 5/2003 | Surnilla | F02D 41/0087 123/481 |
| 2003/0221659 | A1 * | 12/2003 | Surnilla | F02D 41/1453 123/305 |

FOREIGN PATENT DOCUMENTS

| | | | | | |
|---|---|---|---|---|---|
| JP | H08189388 | A | * | 7/1996 | |
| JP | 2002054483 | A | * | 2/2002 | |
| JP | 2003056392 | A | * | 2/2003 | F01N 3/2006 |
| JP | 2006-022753 | A | | 1/2006 | |
| JP | 2010174742 | A | * | 8/2010 | |
| WO | WO 2007/016713 | A2 | | 2/2007 | |

* cited by examiner

CONTROLLER AND CONTROL METHOD FOR INTERNAL COMBUSTION ENGINE

BACKGROUND

1. Field

The present disclosure relates to a controller and a control method for an internal combustion engine.

2. Description of Related Art

Japanese Laid-Open Patent Publication No. 2006-22753 discloses a device that temporarily switches an air-fuel ratio to a rich state and then switches it to a lean state, when executing a temperature increasing process of a catalyst for a regeneration process of the catalyst.

When supplying oxygen to an exhaust passage after unburned fuel is discharged to the exhaust passage as described above, the unburned fuel discharged to the exhaust passage may flows downstream from the catalyst, depending on the oxygen storage amount of the catalyst.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first general aspect, a controller for an internal combustion engine is provided. The internal combustion engine is a multi-cylinder internal combustion engine that includes an aftertreatment device in an exhaust passage. The aftertreatment device includes a catalyst that stores oxygen. The controller is configured to execute a temperature increasing process and a scavenging process of the aftertreatment device. The temperature increasing process includes a stopping process and a rich combustion process. The stopping process stops a combustion operation in a first cylinder that is at least one cylinders. The rich combustion process causes an air-fuel ratio of air-fuel mixture in a second cylinder of the cylinders to be less than a stoichiometric air-fuel ratio. The second cylinder is different from the first cylinder. The scavenging process is executed prior to a specific combustion cycle that includes the rich combustion process. The scavenging process includes, during one combustion cycle, the stopping process and a process that causes the air-fuel ratio of the air-fuel mixture in the second cylinder to be greater than or equal to the stoichiometric air-fuel ratio.

The above-described scavenging process causes the exhaust gas discharged to the exhaust passage during one combustion cycle to contain an amount of oxygen greater than or equal to the amount that reacts with unburned fuel. The scavenging process thus increases the oxygen storage amount of the catalyst prior to the rich combustion process by the temperature increasing process. This prevents unburned fuel from flowing downstream from the catalyst due to the rich combustion process by the temperature increasing process.

In the above-described controller for the internal combustion engine, the specific combustion cycle preferably includes a first specific period that is a combustion cycle at a time when the temperature increasing process is started.

The oxygen storage amount of the catalyst may have become relatively small depending on the operating state of the internal combustion engine prior to the start of the temperature increasing process. In this regard, the above-described configuration executes the scavenging process prior to the start of the temperature increasing process. This prevents unburned fuel from flowing downstream from the catalyst due to the rich combustion process by the temperature increasing process.

In the above-described controller for the internal combustion engine, the aftertreatment device preferably includes a filter that traps particulate matter in exhaust gas. The controller is preferably configured to execute a determination process that determines that there is an execution request for executing the temperature increasing process when an amount of the particulate matter trapped by the filter is greater than or equal to a threshold. The temperature increasing process is preferably executed when the determination process determines that there is the execution request and an operating state of the internal combustion engine satisfies a specific condition, and is preferably completed when the amount of the particulate matter is less than or equal to a specific amount. The specific combustion cycle preferably includes a second specific period, the second specific period being a combustion cycle at a time when the temperature increasing process is resumed because the specified condition is satisfied again after the specified condition stops being satisfied during execution of the temperature increasing process.

The oxygen storage amount of the catalyst may have become relatively small depending on the operating state of the internal combustion engine during an interruption period of the temperature increasing process. In this regard, the above-described configuration executes the scavenging process prior to resumption of the temperature increasing process. This prevents unburned fuel from flowing downstream from the catalyst due to the rich combustion process by the temperature increasing process.

In the above-described controller for the internal combustion engine, the temperature increasing process preferably includes a changing process that changes a cylinder in which a combustion operation is stopped by the stopping process. The specific combustion cycle preferably includes a combustion cycle at a time when the changing process changes the cylinder in which the combustion operation is stopped.

The above-described configuration may temporarily extend the interval between cylinders in which the combustion operation is stopped, around the time when the changing process changes the cylinder in which the combustion operation is stopped. The extended interval between the cylinders in which the combustion operation is stopped extends the period in which cylinders are consecutively subjected to the rich combustion process. This causes an excessive amount of unburned fuel to flow to the catalyst. In this regard, the above-described configuration executes the scavenging process prior to changing the cylinder in which the combustion operation is stopped. This shortens the period in which cylinders are consecutively subjected to the rich combustion process.

In the above-described controller for the internal combustion engine, the temperature increasing process preferably includes, during a combustion cycle, both the stopping process and the rich combustion process.

In a case in which the changing process is combined with a configuration in which one combustion cycle of the temperature increasing process includes both the stopping process and the rich combustion process, the interval between the cylinders in which the combustion operation is stopped is likely to be extended temporarily around the time when the cylinder in which the combustion operation is stopped is changed. The present disclosure is particularly suitable for such a configuration.

In a second general aspect, a controller for an internal combustion engine is provided. The internal combustion engine is a multi-cylinder internal combustion engine that includes an aftertreatment device in an exhaust passage. The aftertreatment device includes a catalyst that stores oxygen. The controller includes circuitry. The circuitry is configured to execute a temperature increasing process and a scavenging process of the aftertreatment device. The temperature increasing process includes a stopping process and a rich combustion process. The stopping process stops a combustion operation in a first cylinder that is at least one cylinders. The rich combustion process causes an air-fuel ratio of air-fuel mixture in a second cylinder of the cylinders to be less than a stoichiometric air-fuel ratio. The second cylinder is different from the first cylinder. The scavenging process is executed prior to a specific combustion cycle that includes the rich combustion process. The scavenging process includes, during one combustion cycle, the stopping process and a process that causes the air-fuel ratio of the air-fuel mixture in the second cylinder to be greater than or equal to the stoichiometric air-fuel ratio.

In a third general aspect, a control method for an internal combustion engine is provided. The internal combustion engine is a multi-cylinder internal combustion engine that includes an aftertreatment device in an exhaust passage. The aftertreatment device includes a catalyst that stores oxygen. The control method comprises: executing a temperature increasing process of the aftertreatment device; and executing a scavenging process of the aftertreatment device. The temperature increasing process includes: a stopping process that stops a combustion operation in a first cylinder that is at least one cylinders; and a rich combustion process that causes an air-fuel ratio of air-fuel mixture in a second cylinder of the cylinders to be less than a stoichiometric air-fuel ratio, the second cylinder being different from the first cylinder. The scavenging process is executed prior to a specific combustion cycle that includes the rich combustion process. The scavenging process includes, during one combustion cycle, the stopping process and a process that causes the air-fuel ratio of the air-fuel mixture in the second cylinder to be greater than or equal to the stoichiometric air-fuel ratio.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A first embodiment will now be described with reference to the drawings.

Figure 1:
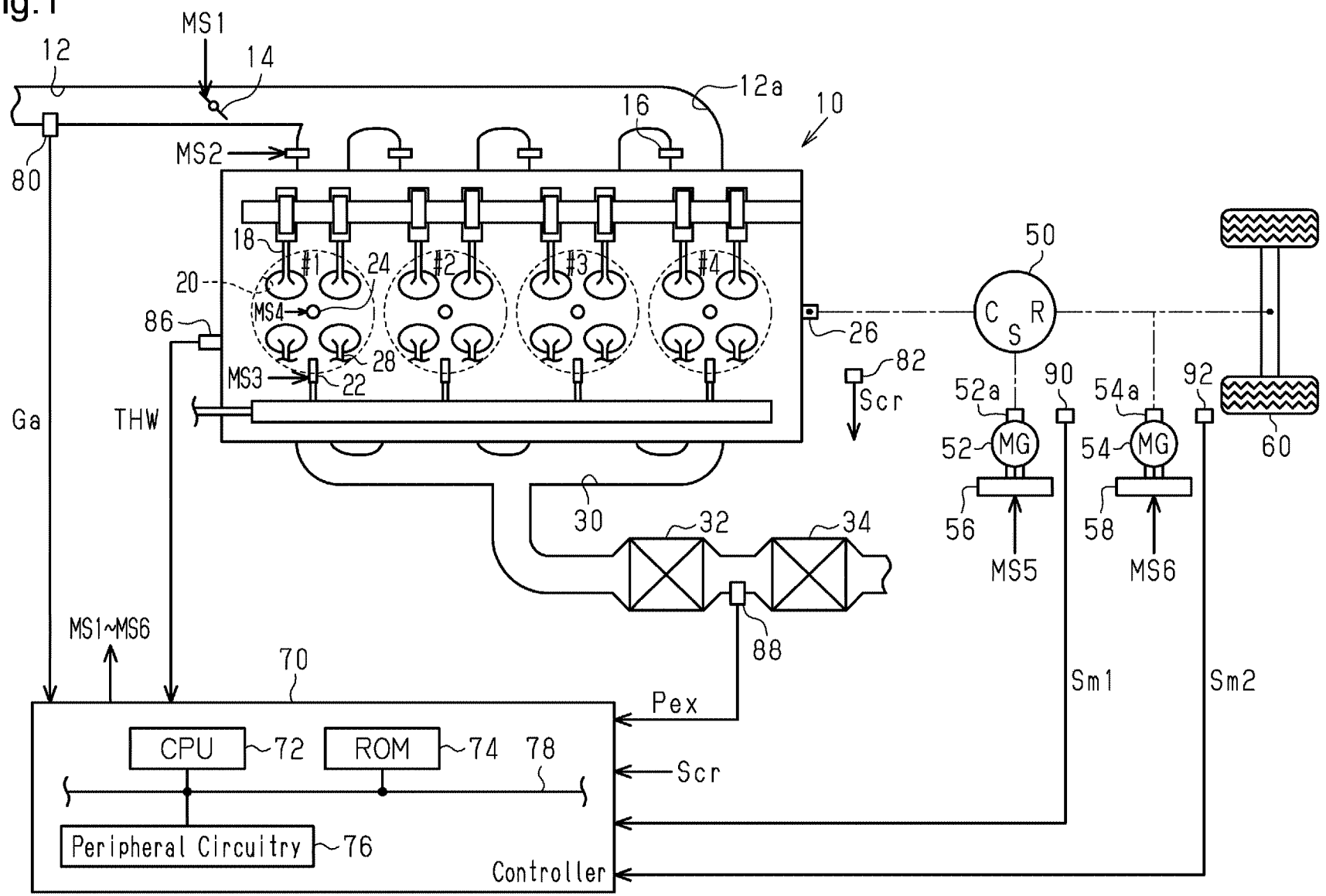
FIG. 1 is a diagram showing a controller according to a first embodiment and the configuration of a drive system.

As shown in FIG. 1, an internal combustion engine 10 includes four cylinders #1 to #4. An intake passage 12 of the internal combustion engine 10 incorporates a throttle valve 14. The intake passage 12 includes intake ports 12*a* in a downstream section. Each intake port 12*a* is provided with a port injection valve 16, which injects fuel into the intake port 12*a*. Air drawn into the intake passage 12 and fuel injected from the port injection valves 16 flow into combustion chambers 20 when intake valves 18 are opened. A direct injection valve 22 injects fuel into each combustion chamber 20. Air-fuel mixture in the combustion chamber 20 is burned by spark discharge of an ignition plug 24. This generates combustion energy, which is in turn converted into rotational energy of a crankshaft 26.

The air-fuel mixture burned in the combustion chambers 20 is discharged to an exhaust passage 30 as exhaust gas when exhaust valves 28 are opened. The exhaust passage 30 is provided with a three-way catalyst 32, which has an oxygen storage capacity, and a gasoline particulate filter (GPF) 34. The GPF 34 includes a filter that traps particulate matter (PM) and supports a three-way catalyst having an oxygen storage capacity.

The crankshaft 26 is mechanically coupled to a carrier C of a planetary gear mechanism 50, which is part of a power splitter. The planetary gear mechanism 50 includes a sun gear S, which is mechanically coupled to a rotary shaft 52*a* of a first motor-generator 52. The planetary gear mechanism 50 includes a ring gear R, which is mechanically coupled to a rotary shaft 54*a* of a second motor-generator 54 and to driven wheels 60. Alternating-current voltage of an inverter 56 is applied to terminals of the first motor-generator 52. Also, alternating-current voltage of an inverter 58 is applied to terminals of the second motor-generator 54.

A controller 70 controls the internal combustion engine 10 and operates operated units of the internal combustion engine 10, such as the throttle valve 14, the port injection valves 16, the direct injection valves 22, and the ignition plugs 24, thereby controlling torque and the ratios of exhaust components, which are controlled variables. Also, the controller 70 controls the first motor-generator 52. Specifically, the controller 70 operates the inverter 56, thereby controlling the rotation speed, which is a controlled variable, of the first motor-generator 52. Further, the controller 70 controls the second motor-generator 54. Specifically, the controller 70 operates the inverter 58, thereby controlling torque, which is a controlled variable, of the second motor-generator 54. FIG. 1 shows operation signals MS1 to MS6 respectively corresponding to the throttle valve 14, the port injection valves 16, the direct injection valves 22, the ignition plugs 24, and the inverters 56, 58. To control controlled variables of the internal combustion engine 10, the controller 70 refers to an intake air amount Ga detected by an air flow meter 80, an output signal Scr of a crank angle sensor 82, a coolant temperature THW detected by a coolant temperature sensor 86, and a pressure Pex of exhaust gas flowing into the GPF 34 detected by an exhaust pressure sensor 88. Further, to control controlled variables of the first motor-generator 52 and the second motor-generator 54, the controller 70 refers to an output signal Sm1 of a first rotation angle sensor 90, which detects a rotation angle of the first motor-generator 52, and an output signal Sm2 of a second rotation angle sensor 92, which detects a rotation angle of the second motor-generator 54.

The controller 70 includes a central processing unit (CPU) 72, a read-only memory (ROM) 74, and peripheral circuitry 76, which can communicate with each other through a communication line 78. The peripheral circuitry 76 includes a circuit that generates a clock signal regulating internal operations, a power supply circuit, and a reset circuit. The controller 70 controls the controlled variables by causing the CPU 72 to execute programs stored in the ROM 74.

Figure 2:
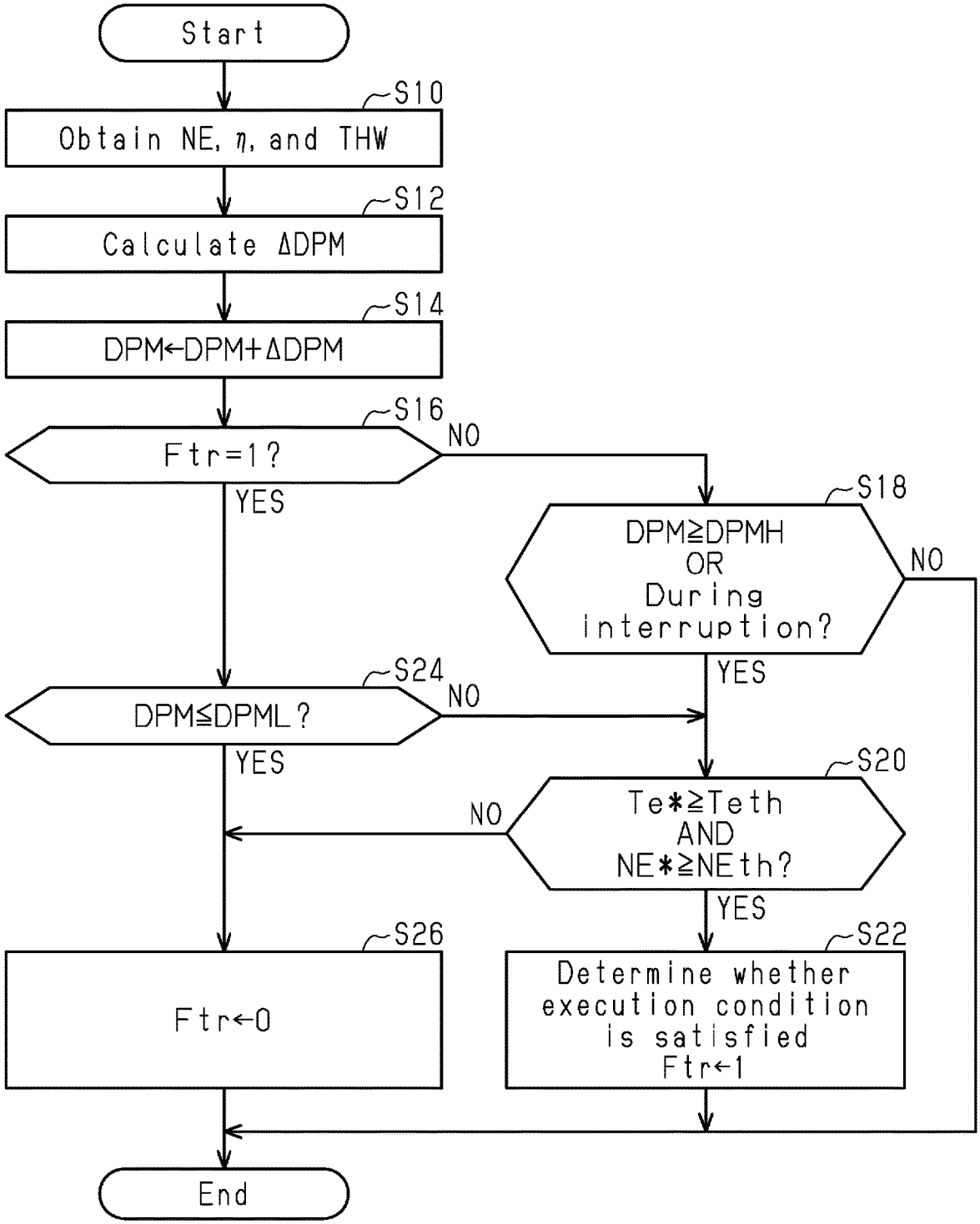
FIG. 2 is a flowchart showing a procedure of processes executed by the controller.

FIG. 2 shows a procedure of processes executed by the controller 70 according to the first embodiment. The process shown in FIG. 2 is implemented by the CPU 72 repeatedly executing programs stored in the ROM 74 with a specific period. In the following description, the number of each step is represented by the letter S followed by a numeral.

In the series of processes shown in FIG. 2, the CPU 72 first obtains a rotation speed NE, a charging efficiency η, and the coolant temperature THW (S10). The rotation speed NE is calculated by the CPU 72 based on the output signal Scr. The charging efficiency η is calculated by the CPU 72 based on the intake air amount Ga and the rotation speed NE. Next, the CPU 72 calculates an update amount ΔDPM of the accumulated amount DPM based on the rotation speed NE, the charging efficiency η, and the coolant temperature THW (S12). The accumulated amount DPM is the amount of PM trapped by the GPF 34. Specifically, the CPU 72 first calculates the amount of PM in the exhaust gas discharged to the exhaust passage 30 based on the rotation speed NE, the charging efficiency η, and the coolant temperature THW. Also, the CPU 72 calculates the temperature of the GPF 34 based on the rotation speed NE and the charging efficiency η. Further, the CPU 72 calculates the update amount ΔDPM based on the amount of PM in the exhaust gas and the temperature of the GPF 34. While executing a process of S40, which will be discussed below, the CPU 72 simply needs to calculate the update amount ΔDPM based on the air-fuel ratio and the intake air amount Ga.

Next, the CPU 72 updates the accumulated amount DPM in accordance with update amount ΔDPM (S14). Subsequently, the CPU 72 determines whether a condition satisfaction flag Ftr is 1 (S16). The value 1 of the condition satisfaction flag Ftr indicates that an execution condition for a temperature increasing process is satisfied, and the value 0 of the condition satisfaction flag Ftr indicates that the execution condition for the temperature increasing process is not satisfied. The temperature increasing process is configured to burn and remove PM in the GPF 34. When the condition satisfaction flag Ftr is 0 (S16: NO), the CPU 72 determines whether the logical disjunction of the following conditions is true: a condition that the accumulated amount DPM is greater than or equal to a regeneration execution value DPMH; and a condition that the process of S40, which will be discussed below, is interrupted (S18). The regeneration execution value DPMH indicates that the amount of PM trapped by the GPF 34 has increased, and is set to a value at which removal of PM is desirable.

When the logical disjunction is true (S18: YES), the CPU 72 determines whether the logical conjunction of a condition (1) and a condition (2) below is true (S20). The conditions (1) and (2) are execution conditions for the temperature increasing process.

Condition (1) A condition that an engine torque command value Te*, which is a command value of torque to the internal combustion engine 10, is greater than or equal to a specific value Teth.

Condition (2) A condition that the rotation speed NE of the internal combustion engine 10 is greater than or equal to a specific speed.

When the logical conjunction is true (S20: YES), the CPU 72 assigns 1 to the condition satisfaction flag Ftr (S22).

When the condition satisfaction flag Ftr is 1 (S16: YES), the CPU 72 determines whether the accumulated amount DPM is less than or equal to a stopping threshold DPML (S24). The stopping threshold DPML is set to a value that indicates that the amount of PM trapped in the GPF 34 has been reduced to a sufficiently low level that allows the regeneration process to be completed. When the accumulated amount DPM is greater than the stopping threshold DPML (S24: NO), the CPU 72 advances the process to S20. When the accumulated amount DPM is less than or equal to the stopping threshold DPML (S24: YES), or when making a negative determination in the process of S20, the CPU 72 assigns 0 to the condition satisfaction flag Ftr (S26).

When completing the process of S22 or S26, or when making a negative determination in the process of S18, the CPU 72 temporarily suspends the series of processes shown in FIG. 2.

Figure 3:
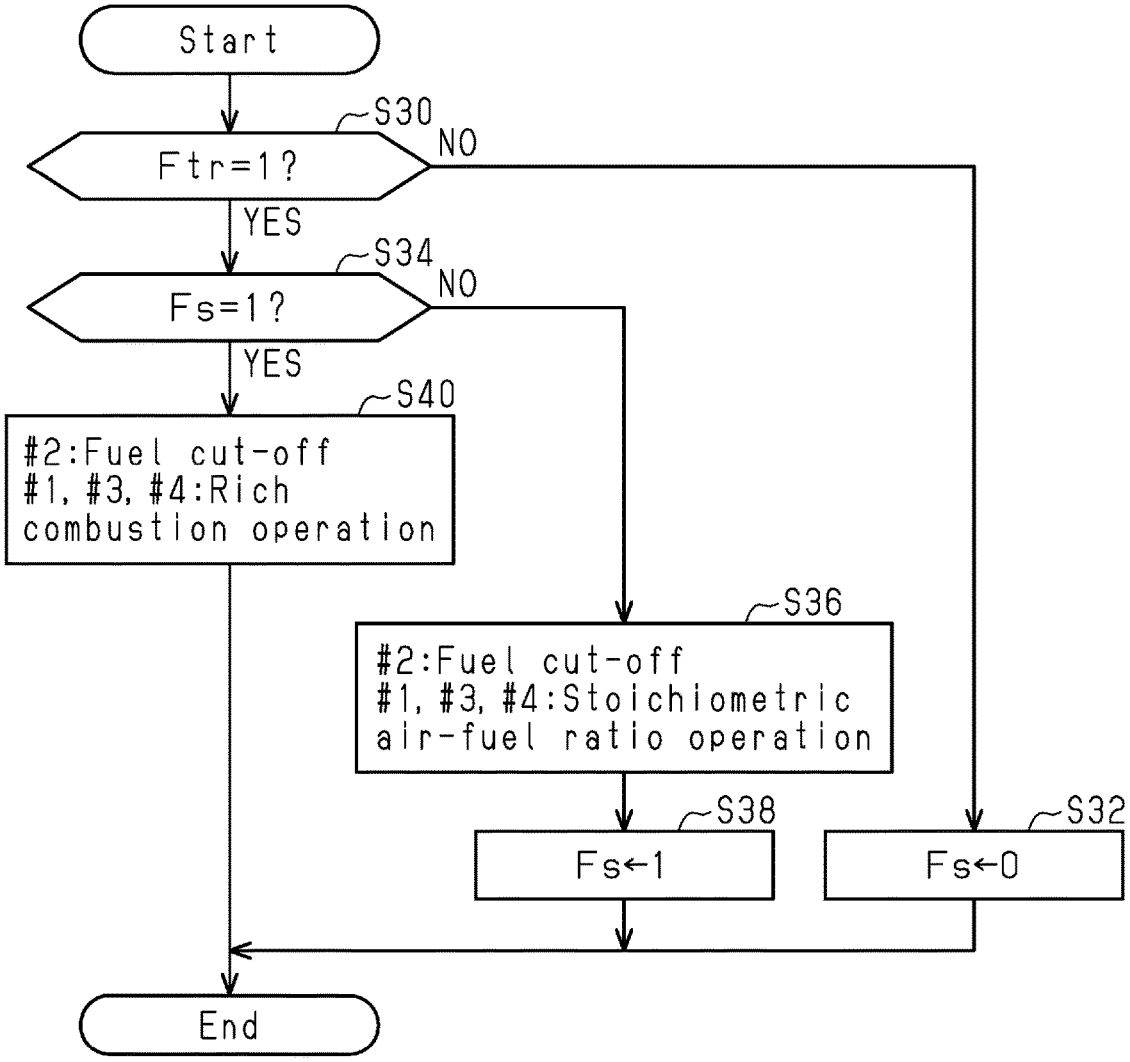
FIG. 3 is a flowchart showing a procedure of processes executed by the controller.

FIG. 3 shows a procedure of processes executed by the controller 70 according to the first embodiment. The process shown in FIG. 3 is implemented by the CPU 72 repeatedly executing programs stored in the ROM 74 with the period of one combustion cycle.

In the series of processes shown in FIG. 3, the CPU 72 first determines whether the condition satisfaction flag Ftr is 1 (S30). When the condition satisfaction flag Ftr is 0 (S30: NO), the CPU 72 assigns 0 to a temperature increase flag Fs (S32). The value 1 of the temperature increase flag Fs indicates that the temperature increasing process is being executed, and the value 0 of the temperature increase flag Fs indicates that the temperature increasing process is not being executed. When the condition satisfaction flag Ftr is 1 (S30: YES), the CPU 72 determines whether the temperature increase flag Fs is 1 (S34).

When the temperature increase flag Fs is 0 (S34: NO), the CPU 72 executes a scavenging process (S36). That is, the CPU 72 executes a fuel cut-off process to stop the combustion operation in the cylinder #2 (first cylinder). Also, the CPU 72 continues the combustion operation in the cylinders #1, #3, and #4 (second cylinders) while causing the air-fuel ratio of air-fuel mixture to become the stoichiometric air-fuel ratio. Accordingly, the amount of oxygen in the exhaust gas discharged to the exhaust passage 30 during one combustion cycle exceeds the amount of oxygen that reacts with the unburned fuel without excess or deficiency. This supplies excessive oxygen to the three-way catalyst 32. The CPU 72 then assigns 1 to a temperature increase flag Fs (S38).

When the temperature increase flag Fs is 1 (S34: YES), the CPU 72 executes the temperature increasing process (S40). Specifically, the CPU 72 stops fuel injection from the port injection valve 16 and the direct injection valve 22 of the cylinder #2, and causes the air-fuel ratio of the air-fuel mixture in the combustion chambers 20 of the cylinders #1, #3, and #4 to be richer than the stoichiometric air-fuel ratio. The first objective of this process is to increase the temperature of the three-way catalyst 32. That is, this process discharges oxygen and unburned fuel to the exhaust passage 30 to oxide the unburned fuel in the three-way catalyst 32, thereby increasing the temperature of the three-way catalyst 32. The second objective of this process is to increase the temperature of the GPF 34, to supply oxygen to the heated GPF 34, and to remove the PM trapped by the GPF 34 through oxidation. That is, when the temperature of the three-way catalyst 32 is relatively high, high-temperature exhaust gas flows into the GPF 34, so that the temperature of the GPF 34 is increased. When, oxygen flows into the heated GPF 34, the PM trapped by the GPF 34 is removed through oxidation.

The CPU 72 sets the air-fuel ratio of air-fuel mixture in the cylinders #1, #3, and #4 such that the amount of unburned fuel in the exhaust gas discharged to the exhaust passage 30 from the cylinders #1, #3, and #4 is less than or equal to the amount that reacts with oxygen discharged from the cylinder #2 without excess or deficiency. Specifically, in order to increase the temperature of the three-way catalyst 32 at an early stage in the beginning of the regeneration process of GPF 34, the air-fuel ratio of the air-fuel mixture in the cylinders #1, #3, and #4 is set to a value that is closest to the amount that reacts with the oxygen discharged from the cylinder #2 without excess or deficiency. In contrast, after the temperature of the GPF 34 is increased, the air-fuel ratio of the air-fuel mixture in the cylinders #1, #3, and #4 is set to be less than the amount that reacts with the oxygen discharged from the cylinder #2 without excess or deficiency, in order to supply oxygen to the GPF 34.

When completing the process of S32, S38, or S40, the CPU 72 temporarily suspends the series of processes shown in FIG. 3. When making a negative determination in the process of S30, the CPU 72 does not execute the process of S40. Accordingly, when making an affirmative determination in the process of S24, the CPU 72 stops the process of S40. When making a negative determination in the process of S20 in a case in which the condition satisfaction flag Ftr is 1, the CPU 72 interrupts the process of S40.

Operation and advantages of the first embodiment will now be described.

Figure 4A:
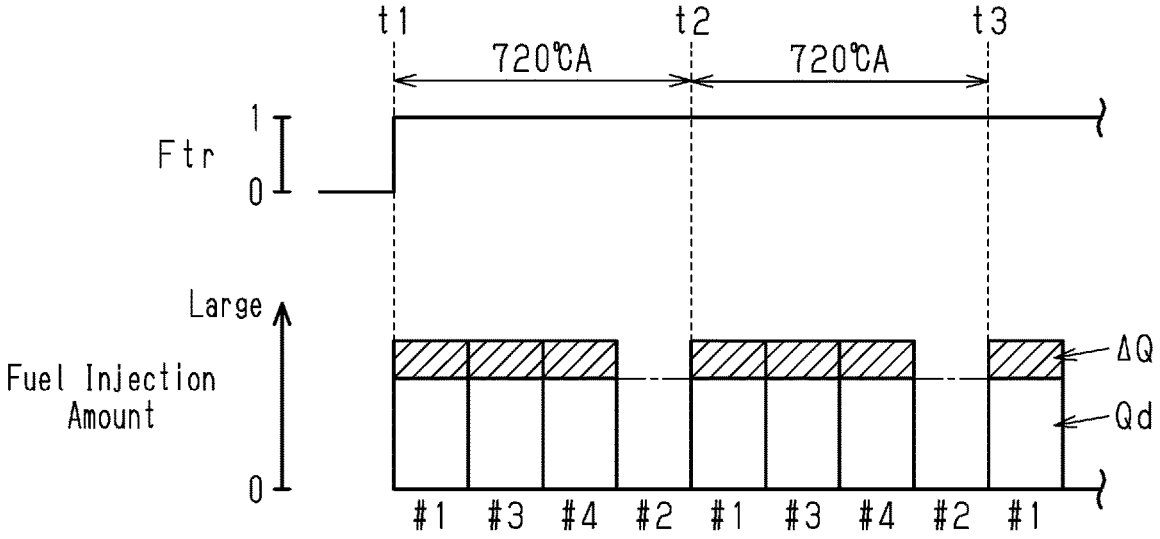
FIGS. 4A and 4B are timing diagrams showing temperature increasing processes according to a comparative example and the first embodiment.

FIG. 4A shows a process for PM removal according to a comparative example for the first embodiment. In this comparative example, the condition satisfaction flag Ftr becomes 1 at a point in time t1 as shown in FIG. 4A, which immediately starts the temperature increasing process is started. In the first embodiment, the combustion stroke occurs in order of the cylinder #1, the cylinder #3, the cylinder #4, and the cylinder #2. Thus, immediately after the start of the temperature increasing process, the exhaust gas discharged to the exhaust passage 30 from three cylinders contains an excessive amount of unburned fuel.

FIG. 4A shows an amount of increase ΔQ that is added, during the temperature increasing process, to a requested injection amount Qd, with which the air-fuel ratio of air-fuel mixture becomes the stoichiometric air-fuel ratio. The amount of fuel that is three times the amount of increase ΔQ is less than or equal to the amount that reacts with the oxygen discharged to the exhaust passage 30 from the cylinder #2 without excess or deficiency. In the case of the first embodiment, unburned fuel the amount of which is represented by 3−ΔQ is first discharged from the cylinders #1, #3, and #4 after the temperature increasing process is started. The oxygen storage amount of the three-way catalyst 32 may have been reduced for some reason. In such a case, the unburned fuel discharged to the three-way catalyst 32 from the cylinders #1, #3, and #4 may fail to be sufficiently oxidized in the three-way catalyst 32, increasing the amount of the unburned fuel flowing downstream from the three-way catalyst 32.

Figure 4B:
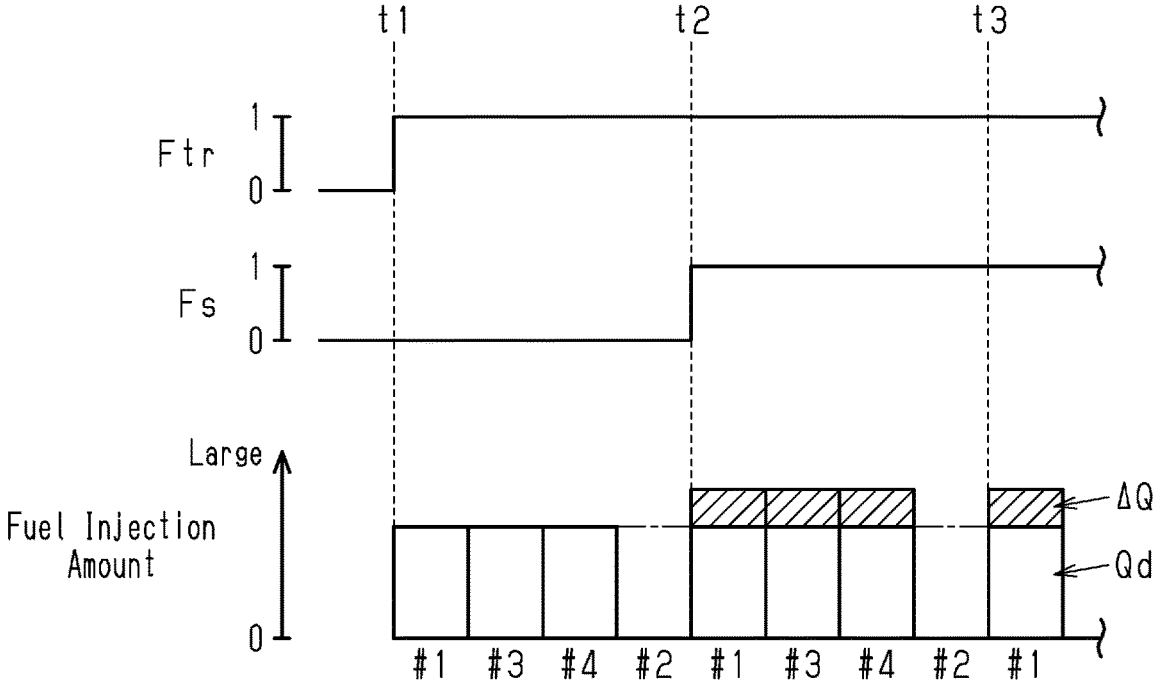

FIG. 4B shows an example of the process of PM removal according to the first embodiment. When assigning 1 to the condition satisfaction flag Ftr at the point in time t1 as shown in FIG. 4B, the CPU 72 executes the scavenging process over one combustion cycle. This supplies excessive oxygen to the three-way catalyst 32, increasing the oxygen storage amount of the three-way catalyst 32. At a point in time t2, at which the scavenging process over one combustion cycle is completed, the CPU 72 assigns 1 to the temperature increase flag Fs to execute the temperature increasing process. Accordingly, in the combustion cycle from the point in time t2 to a point in time t3, unburned fuel is discharged from the cylinders #1, #3, and #4 and flows into the three-way catalyst 32. The three-way catalyst 32 is capable of oxidizing the unburned fuel.

In this manner, the first embodiment executes the scavenging process prior to the temperature increasing process. Accordingly, at the start of the temperature increasing process, the oxygen storage amount of the three-way catalyst 32 is sufficient.

The first embodiment further has the following operation and advantages.

(1) The scavenging process is executed without exception prior to the start of the temperature increasing process. This simplifies the process related to regeneration of the GPF 34 as compared to a case in which whether to execute the scavenging process is determined according to the oxygen storage amount of the three-way catalyst 32.

(2) In some cases, the accumulated amount DPM remains greater than the stopping threshold DPML and the PM removal process of the GPF 34 is not completed after the temperature increasing process is started. In such a case, if a negative determination is made in the process of S20 so that the temperature increasing process is interrupted, 0 is assigned to the condition satisfaction flag Ftr and the temperature increase flag Fs. Accordingly, the scavenging process is executed when the temperature increasing process is resumed. Thus, even if the oxygen storage amount of the three-way catalyst 32 has become relatively small due to the operating state of the internal combustion engine 10 during an interruption period of the temperature increasing process, the scavenging process, which is executed when the temperature increasing process is resumed, prevents unburned fuel from flowing downstream from the three-way catalyst 32.

(3) The scavenging process is executed without exception prior to resumption of the temperature increasing process. This simplifies the process related to regeneration of the GPF 34, for example, as compared to a case in which whether to execute the scavenging process is determined according to the oxygen storage amount of the three-way catalyst 32.

Second Embodiment

A second embodiment will now be described with reference to the drawings. The differences from the first embodiment will mainly be discussed.

If the cylinder in which the combustion operation is stopped is fixed, locations at which oxygen and unburned fuel flow into the three-way catalyst 32 may be unevenly distributed. Taking this into consideration, the second embodiment changes the cylinder in which the combustion operation is stopped in the temperature increasing process every specific number of cycles. This prevents the locations at which oxygen and unburned fuel flow into the three-way catalyst 32 from being uneven during one regeneration process until the accumulated amount DPM becomes less than or equal to the stopping threshold DPML.

Figure 5:
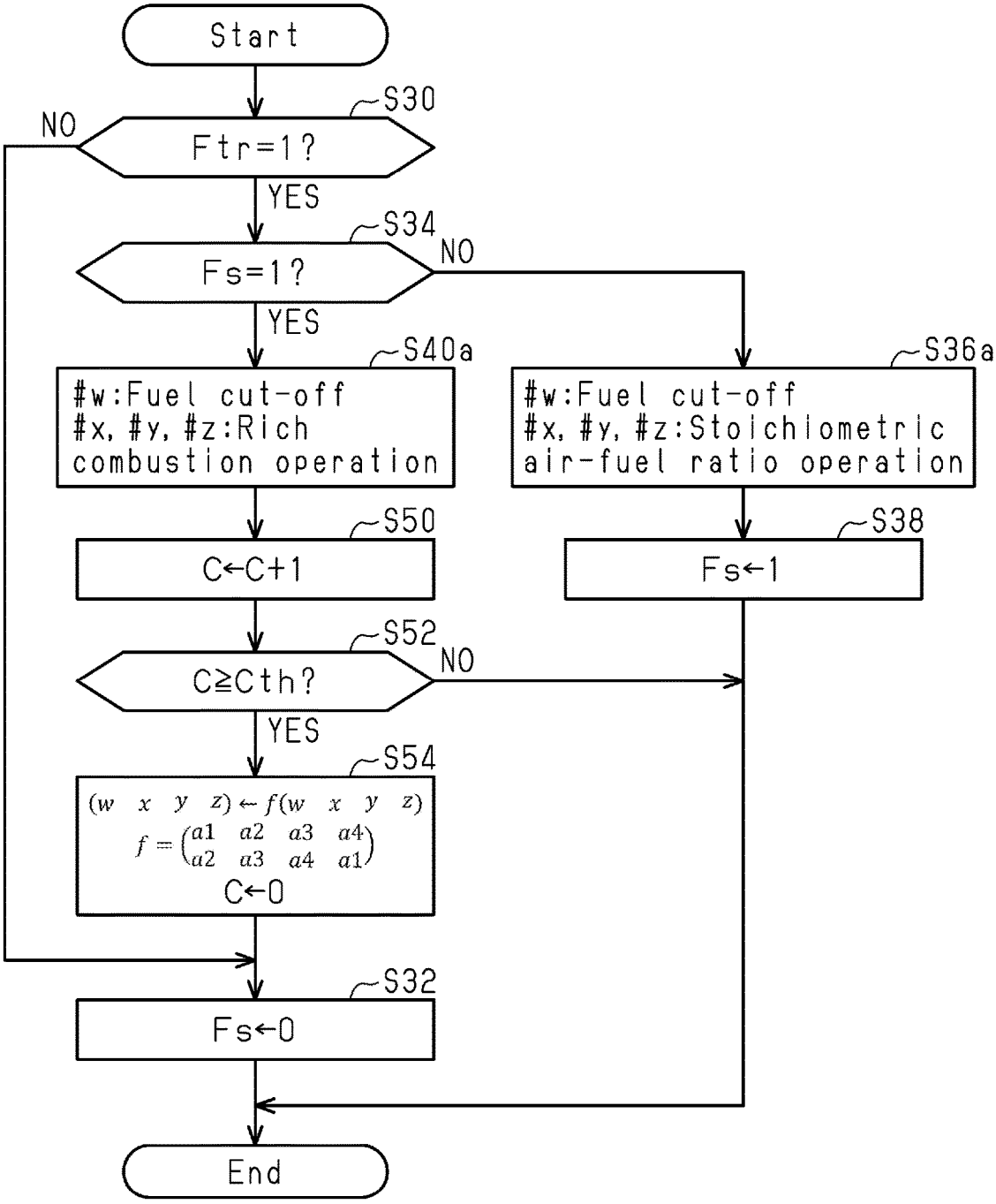
FIG. 5 is a flowchart showing a procedure of processes executed by a controller according to a second embodiment.

FIG. 5 shows a procedure of processes executed by a controller 70 according to the second embodiment. The process shown in FIG. 5 is implemented by the CPU 72 repeatedly executing programs stored in the ROM 74 with the period of one combustion cycle. In FIG. 5, the same step numbers are given to the processes that correspond to those in FIG. 3.

In the series of processes shown in FIG. 5, when the temperature increase flag Fs is 1 (S34: YES), the CPU 72 executes a temperature increasing process (S40*a*). In the temperature increasing process according to the second embodiment, the cylinder in which the combustion operation is stopped is defined as a cylinder #w. The cylinders in which the combustion operation is continued with the air-fuel ratio of air-fuel mixture made richer than the stoichiometric air-fuel ratio are defined as cylinders #x, #y, #z (S40*a*). In this example, 1, 2, 3, and 4 are respectively assigned to w, x, y, and z.

Then CPU 72 increments a counter C, which measures the time for which the cylinder in which the combustion operation is stopped is fixed (S50). Also, the CPU 72 determines whether the counter C is greater than or equal to a threshold Cth (S52). The threshold Cth defines the length of time for which the cylinder in which the combustion operation is stopped is fixed. When the counter C is greater than or equal to the threshold Cth (S52: YES), the CPU 72 changes the cylinder in which the combustion operation is stopped and initializes the counter C (S54). Specifically, the CPU 72 changes the cylinder in which the combustion operation is stopped in order of the cylinder #1, #2, #3, and #4 through cyclic permutation.

When completing the process of S54, or when making a negative determination in the process of S30, the CPU 72 proceeds to the process of S32.

When the temperature increase flag Fs is 0 (S34: NO), the CPU 72 executes the scavenging process to set the cylinder #w to the cylinder in which the combustion operation is stopped (S36*a*). Thereafter, the CPU 72 proceeds to the process of S38.

In this manner, the second embodiment assigns 0 to the temperature increase flag Fs even when the process of S54 is executed. Accordingly, the scavenging process is executed prior to the execution of the temperature increasing process after the cylinder #w, in which the combustion operation is stopped, is changed.

Operation and advantages of the second embodiment will now be described.

Figure 6A:
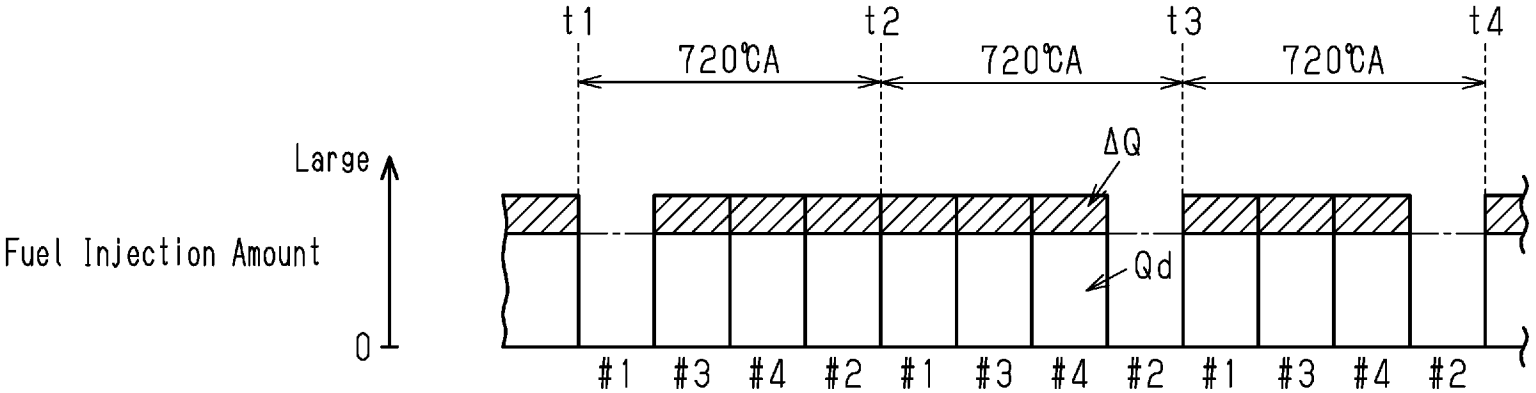
FIGS. 6A and 6B are timing diagrams showing temperature increasing processes according to a comparative example and the second embodiment.

FIG. 6A shows a process for PM removal according to a comparative example for the second embodiment. In the comparative example shown in FIG. 6A, although the process for changing the cylinder subject to the combustion operation is executed, the scavenging process is not executed prior to the change of the cylinder.

In the example of FIG. 6A, the combustion operation in the cylinder #1 is stopped in the combustion cycle from the point in time t1 to the point in time t2, and the combustion operation in the cylinder #2 is stopped in the combustion cycle from the point in time t2 to the point time t3. In this case, after oxygen is supplied to the three-way catalyst 32 as the combustion operation in the cylinder #1 is stopped in the combustion cycle from the point in time t1 to the point in time t2, fuel of the amount of increase ΔQ is supplied as unburned fuel to the three-way catalyst 32 consecutively from six cylinders. Thus, the oxygen stored in the three-way catalyst 32 may be insufficient in relation to the amount required to oxidize the unburned fuel flowing into the three-way catalyst 32.

Figure 6B:
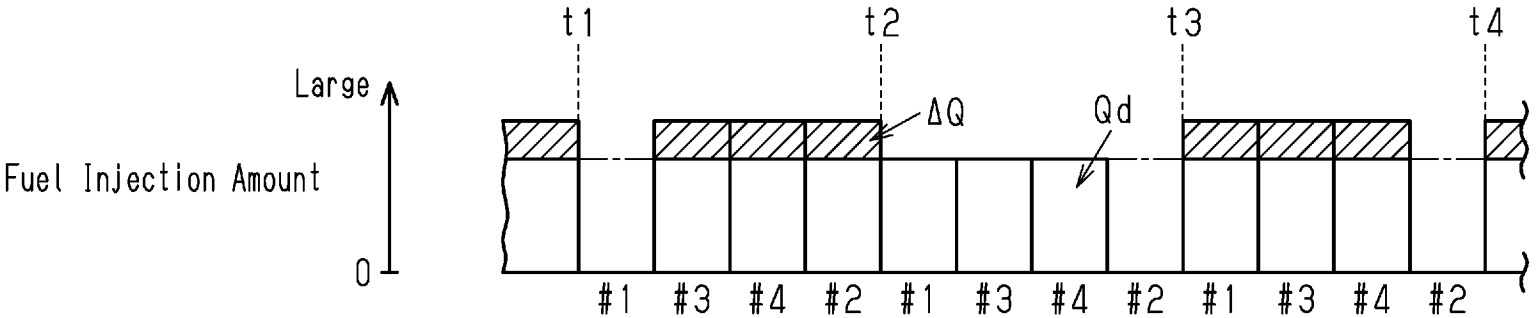

FIG. 6B shows an example of the process of PM removal according to the second embodiment. As shown in FIG. 6B, the second embodiment executes the scavenging process between the combustion cycle from the point time t1 to the point in time t2, in which the temperature increasing process is executed with the combustion operation in the cylinder #1 stopped, and the combustion cycle from the point in time t3 to the point in time t4, in which the temperature increasing process is executed with the combustion operation in the cylinder #2 stopped. This ensures a sufficient amount of oxygen stored in the three-way catalyst 32 when the temperature increasing process with the combustion operation in the cylinder #1 stopped is changed to the temperature increasing process with the combustion operation in the cylinder #2 stopped.

<Correspondence>

The correspondence between the items in the above-described embodiments and the items the WHAT IS CLAIMED IS section is as follows. Below, the correspondence is shown for each claim number.

[1, 6, 7] The aftertreatment device corresponds to the three-way catalyst 32 and the GPF 34. Temperature increasing process corresponds to the processes of S40 and S40*a*. The scavenging process corresponds to the processes of S36 and S36*a*. The stopping process corresponds to the fuel cut-off process in the cylinder #2 in the processes of S36 and S40, and to the fuel-cut off process in the cylinder #w in the processes of S36*a* and S40*a*. The rich combustion process corresponds to the rich combustion process in the cylinders #1, #3, and #4 in the process S40, and to the rich combustion process in the cylinders #x, #y, #z in the process of S40*a*. The specific combustion cycle corresponds to the period from the point in time t2 to the point in time t3 in FIG. 4, and to the period from the point in time t3 to the point in time t4 in FIG. 6.

[2] The first specific period corresponds to the period from the pint in time t2 to the point in time t3 in FIG. 4.

[3] The filter corresponds to the GPF 34. The determination process corresponds to the process of S18, and the specific condition corresponds to the conditions (1) and (2) of S20. The case in which the amount of particulate matter is less than or equal to the specific amount corresponds to the case in which an affirmative determination is made in the process of S24. The second specific period corresponds to the combustion cycle subsequent to a combustion cycle in which, after a negative determination is made in the process of S20 and 0 is assigned to the condition satisfaction flag Ftr although 1 is assigned to the condition satisfaction flag Ftr, so that a negative determination is made in the process of S24, 1 is assigned to the condition satisfaction flag Ftr, so that a negative determination is made in the process of S34.

[4] The changing process corresponds to the process of S54. The phrase "includes a combustion cycle of a case in which the cylinder in which the combustion operation is stopped by the changing process is changed" corresponds to the combustion cycle subsequent to the process of S36*a* executed by the process of S32 executed subsequent to the process of S54.

[5] claim 5 corresponds to the processes shown in FIGS. 4 and 6.

Other Embodiments

The above-described embodiments may be modified as follows. The above-described embodiments and the following modifications can be combined as long as the combined modifications remain technically consistent with each other.

Modification Related to Scavenging Process

In the processes of S36 and S36*a*, the air-fuel mixture of the air-fuel mixture in the cylinder in which the combustion operation is not stopped (second cylinder) is set to the stoichiometric air-fuel ratio. However, the present disclosure is not limited to this. For example, the air-fuel ratio may be leaner than the stoichiometric air-fuel ratio.

In the scavenging process, the number of cylinders in which the combustion operation is stopped in one combustion cycle is not limited to one.

The execution time of the scavenging process is not limited to one combustion cycle, but may be two combustion cycles. Also, the execution time of the scavenging process does not necessarily need to be an integral multiple of the combustion cycle, but may be time corresponding to three revolutions of the crankshaft 26.

In the above-described embodiments, when a temperature increase request is newly made to start the temperature increasing process, the scavenging process is executed without exception prior to the start of the temperature increasing process. However, the present disclosure is not limited to this. For example, the scavenging process may be executed only when the oxygen storage amount of the three-way catalyst 32 is less than or equal to a specific amount. Whether the oxygen storage amount is less than or equal to the specific amount can be determined through a process that calculates an estimated value of the oxygen storage amount. Specifically, an air-fuel ratio sensor may be provided in a section upstream of the three-way catalyst 32, and the amount of oxygen flowing into the three-way catalyst 32 is obtained based on the intake air amount and the detected value of this upstream air-fuel ratio sensor. The calculating process of the estimated value may be implemented by accumulating the amount of unburned fuel and the amount of oxygen flowing into the three-way catalyst 32.

In the above-described embodiments, when the execution condition for the temperature increasing process stops being satisfied during the execution, so that the temperature increasing process is interrupted, the scavenging process is executed without exception prior to resumption of the temperature increasing process. However, the present disclosure is not limited to this. For example, the scavenging process may be executed only when the oxygen storage amount of the three-way catalyst 32 is less than or equal to a specific amount. Whether the oxygen storage amount is less than or equal to the specific amount can be determined through a process that calculates an estimated value of the oxygen storage amount. Specifically, an air-fuel ratio sensor may be provided in a section upstream of the three-way catalyst 32, and the amount of oxygen flowing into the three-way catalyst 32 is obtained based on the intake air amount and the detected value of this upstream air-fuel ratio sensor. The calculating process of the estimated value may be implemented by accumulating the amount of unburned fuel and the amount of oxygen flowing into the three-way catalyst 32.

In the above-described embodiments, when the cylinder in which the combustion operation is stopped is changed from the first cylinder to the second cylinder during the execution of the temperature increasing process, the scavenging process is executed without exception after the temperature increasing process and before the subsequent temperature increasing process, instead of continuing the temperature increasing process while stopping the combustion operation in the second cylinder. However, the present disclosure is not limited to this. For example, the scavenging process may be executed only when the oxygen storage amount of the three-way catalyst 32 is less than or equal to a specific amount. Whether the oxygen storage amount is less than or equal to the specific amount can be determined through a process that calculates an estimated value of the oxygen storage amount. Specifically, an air-fuel ratio sensor may be provided in a section upstream of the three-way catalyst 32, and the amount of oxygen flowing into the three-way catalyst 32 is obtained based on the intake air amount and the detected value of this upstream air-fuel ratio sensor. The calculating process of the estimated value may be implemented by accumulating the amount of unburned fuel and the amount of oxygen flowing into the three-way catalyst 32. However, the present disclosure is not limited to this. For example, whether to execute the scavenging process may be determined in accordance with the ratio of fuel amount increase in the cylinder in which the combustion operation is continued, and the length of a period in which the combustion operation is continued temporarily due to the change of the cylinder in which the combustion operation is stopped. That is, when the temperature of the three-way catalyst 32 increases to a certain extent, the temperature increasing process preferably reduces the ratio of fuel amount increase in the cylinder in which the combustion operation is stopped in order to suppress an overshoot of the temperature. In such a case, the scavenging process, which would otherwise accompany the change of the cylinder in which the combustion operation is stopped, may be unnecessary, depending on the reduced ratio of fuel amount increase. Also, in the above-described embodiments, the duration of the combustion operation without an intervening scavenging process is the longest when the cylinder in which the combustion operation is stopped is changed from the cylinder #1 to the cylinder #2. Therefore, in other cases, the scavenging process that would accompany the change of the cylinder in which the combustion operation is stopped may be unnecessary depending on the ratio of fuel amount increase or the like.

In the above-described embodiments, the cylinder in which the combustion operation is stopped during the scavenging process is the same as the cylinder in which the combustion operation is stopped during the temperature increasing process. However, the present disclosure is not limited to this.

Modification Related to Temperature Increasing Process

In the processes of S40 and S40*a*, the number of cylinders in which the combustion operation is stopped in one combustion cycle is one. However, the number of such cylinders may be two.

The period of the temperature increasing process does not necessarily need to correspond to one combustion cycle. For example, in a case in which the internal combustion engine includes four cylinders as in the above-described embodiments, the period of the temperature increasing process may correspond to five times the interval of the occurrence of the compression top dead center, and the combustion operation of one cylinder may be stopped in each period. This allows the cylinder in which the combustion operation is stopped to be changed for each period.

Modification Related to Execution Condition for Temperature Increasing Process

In the above-described embodiments, the specific condition for executing the temperature increasing process when a request for executing the temperature increasing process is made incudes the condition (1) and the condition (2). The specific condition is not limited to these conditions. For example, the condition may include only one of the condition (1) and the condition (2).

Modification Related to Changing Process

The cyclic permutation in the process of S54 is configured to change the cylinder in which the combustion operation is stopped in order of the cylinder #1, #2, #3, and #4. However, the present disclosure is not limited to this.

The changing process is not limited to a process that changes the cylinder in which the combustion operation is stopped through cyclic permutation for each period corresponding to multiplied combustion cycle. For example, a cylinder may be provided in which the combustion operation is stopped only once at a predetermined point in time during a period that is five times the interval of the occurrence of the compression top dead center as described in the section of "Modification related to Temperature Increasing Process".

The changing process is not limited to a process in which all the cylinders #1, #2, #3, and #4 are subject to stopping of the combustion operation. For example, the cylinders in which the combustion operation is stopped may be limited to two specific cylinders, and the cylinder in which the combustion operation is stopped and the cylinder in which the combustion operation is not stopped may be switched for each specific period. This also allows locations at which unburned fuel and oxygen flow into the three-way catalyst 32 to be evenly distributed, as compared to a case in which the cylinder in which the combustion operation is stopped is fixed to one cylinder.

The objective of the changing process is not limited to preventing locations at which unburned fuel and oxygen flow into the three-way catalyst 32 from being uneven. For example, the objective may be to control the frequency of torque fluctuation due to changing the cylinder in which the combustion operation. For example, in an internal combustion engine having four cylinders, the objective can be achieved by providing a cylinder in which the combustion operation is stopped only once at a predetermined point in time during a period that is five times the interval of the occurrence of the compression top dead center as described in the section of "Modification related to Temperature Increasing Process". That is, the frequency of the torque fluctuation varies depending on whether the period with which the cylinder in which the combustion operation is stopped is four or five times the interval of the compression top dead center.

Modification Related to Estimation of Accumulated Amount

A process for estimating the accumulated amount DPM is not limited to that illustrated in FIG. 2. The accumulated amount DPM may be estimated based on the intake air amount Ga and the pressure difference between the upstream side and the downstream side of the GPF 34. Specifically, the accumulated amount DPM may be estimated to be larger when the pressure difference is relatively large than when the pressure difference is relatively small. Also, even if the pressure difference is the same, the accumulated amount DPM may be estimated to be larger when the intake air amount Ga is relatively small than when the intake air amount Ga is relatively large. In a case in which the pressure on the downstream side of the GPF 34 is regarded to be constant, the above-described pressure Pex can be used in place of the pressure difference.

Modification Related to Aftertreatment Device

The aftertreatment device does not necessarily include the GPF 34 be placed on the downstream side of the three-way catalyst 32. The aftertreatment device may include the three-way catalyst 32 placed on the downstream side of the GPF 34. The aftertreatment device does not necessarily need to include both the three-way catalyst 32 and the GPF 34, but may include only the GPF 34. Even in a case in which the aftertreatment device includes only the three-way catalyst 32, the processes described in the above-described embodiments and modifications are effective if the aftertreatment device needs to be heated during the regeneration process. In a case in which the aftertreatment device includes both the three-way catalyst 32 and the GPF 34, the GPF 34 is not limited to a filter supporting a three-way catalyst, but may be a simple filter.

Modification Related to Controller

The controller is not limited to a device that includes the CPU 72 and the ROM 74 and executes software processing. For example, at least part of the processes executed by the software in the above-described embodiments may be executed by hardware circuits dedicated to executing these processes (such as an application-specific integrated circuit (ASIC)). That is, the controller may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. Multiple software processing devices each including a processor and a program storage device and multiple dedicated hardware circuits may be provided.

Modification Related to Vehicle

The vehicle is not limited to a series-parallel hybrid vehicle, but may be a parallel hybrid vehicle or a series hybrid vehicle. Further, the vehicle is not limited to a hybrid electric vehicle, but may be a vehicle that includes only the internal combustion engine 10 as a driver force generator.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine, wherein the internal combustion engine includes multiple cylinders and an aftertreatment device in an exhaust passage, the aftertreatment device includes a catalyst that stores oxygen, the controller is configured to execute a temperature increasing process and a scavenging process of the aftertreatment device, the temperature increasing process includes:

a stopping process that stops a combustion operation in a first cylinder of the cylinders; and a rich combustion process that causes an air-fuel ratio of air-fuel mixture in a second cylinder of the cylinders to be less than a stoichiometric air-fuel ratio, the second cylinder being different from the first cylinder, the scavenging process is executed prior to a specific combustion cycle that includes the rich combustion process, the scavenging process includes, during one combustion cycle:

the stopping process; and a process that causes the air-fuel ratio of the air-fuel mixture in the second cylinder to be greater than or equal to the stoichiometric air-fuel ratio.

2. The controller for the internal combustion engine according to claim 1, wherein the specific combustion cycle includes a first specific period that is a combustion cycle at a time when the temperature increasing process is started.

3. The controller for the internal combustion engine according to claim 1, wherein the aftertreatment device includes a filter that traps particulate matter in exhaust gas, the controller is configured to execute a determination process that determines that there is an execution request for executing the temperature increasing process when an amount of the particulate matter trapped by the filter is greater than or equal to a threshold, the temperature increasing process is executed when the determination process determines that there is the execution request and an operating state of the internal combustion engine satisfies a specific condition, and is completed when the amount of the particulate matter is less than or equal to a specific amount, and the specific combustion cycle includes a second specific period, the second specific period being a combustion cycle at a time when the temperature increasing process is resumed because the specified condition is satisfied again after the specified condition stops being satisfied during execution of the temperature increasing process.

4. The controller for the internal combustion engine according to claim 1, wherein the temperature increasing process includes a changing process that changes a cylinder in which a combustion operation is stopped by the stopping process, and the specific combustion cycle includes a combustion cycle at a time when the changing process changes the cylinder in which the combustion operation is stopped.

5. The controller for the internal combustion engine according to claim 1, wherein the temperature increasing process includes, during a combustion cycle, both the stopping process and the rich combustion process.

6. A controller for an internal combustion engine, wherein the internal combustion engine includes multiple cylinders and an aftertreatment device in an exhaust passage, the aftertreatment device includes a catalyst that stores oxygen, the controller includes circuitry, the circuitry being configured to execute a temperature increasing process and a scavenging process of the aftertreatment device, the temperature increasing process includes:

a stopping process that stops a combustion operation in a first cylinder of the cylinders; and a rich combustion process that causes an air-fuel ratio of air-fuel mixture in a second cylinder of the cylinders to be less than a stoichiometric air-fuel ratio, the second cylinder being different from the first cylinder, the scavenging process is executed prior to a specific combustion cycle that includes the rich combustion process, the scavenging process includes, during one combustion cycle:

the stopping process; and a process that causes the air-fuel ratio of the air-fuel mixture in the second cylinder to be greater than or equal to the stoichiometric air-fuel ratio.

7. A control method for an internal combustion engine, wherein the internal combustion engine includes multiple cylinders and an aftertreatment device in an exhaust passage, the aftertreatment device includes a catalyst that stores oxygen, the control method comprises:

executing a temperature increasing process of the aftertreatment device; and executing a scavenging process of the aftertreatment device, the temperature increasing process includes:

a stopping process that stops a combustion operation in a first cylinder of the cylinders; and a rich combustion process that causes an air-fuel ratio of air-fuel mixture in a second cylinder of the cylinders to be less than a stoichiometric air-fuel ratio, the second cylinder being different from the first cylinder, the scavenging process is executed prior to a specific combustion cycle that includes the rich combustion process, and the scavenging process includes, during one combustion cycle:

the stopping process; and a process that causes the air-fuel ratio of the air-fuel mixture in the second cylinder to be greater than or equal to the stoichiometric air-fuel ratio.

* * * * *